US005342140A

United States Patent [19]

Glass

[11] Patent Number: 5,342,140

[45] Date of Patent: Aug. 30, 1994

[54] FLASHER LIGHT MOUNTING ASSEMBLY FOR TRAFFIC BARRICADES

[75] Inventor: Geoffrey M. Glass, Rolling Meadows, Ill.

[73] Assignee: Plasticade Products Corporation, Rolling Meadows, Ill.

[21] Appl. No.: 85,345

[22] Filed: Jun. 30, 1993

[51] Int. Cl.[5] ..... E01F 13/00

[52] U.S. Cl. ..... 404/9; 404/10; 362/190; 362/191; 340/908.1; 116/63 R

[58] Field of Search ..... 116/63 R, 63 P, 63 C, 116/DIG. 16; 404/11, 6, 10, 9; 49/49; 40/564; 362/191, 200

[56] References Cited

U.S. PATENT DOCUMENTS

| | | | |
|---|---|---|---|
| 3,566,856 | 3/1971 | Linstead | 248/439 |
| 4,387,416 | 6/1983 | Decker | 362/191 |
| 4,516,109 | 5/1985 | Thurston | 116/63 R |

OTHER PUBLICATIONS

Specification Sheet published by Roadmarker/Contico in 1981.

Illustration From Best Barricade Price List published by Best Barricade on May 1, 1981.

*Primary Examiner*—Ramon S. Britts

*Assistant Examiner*—Pamela O'Connor

*Attorney, Agent, or Firm*—Willian Brinks Hofer Gilson & Lione

[57] ABSTRACT

A mounting assembly includes a bracket, flasher light unit, and barricade. The bracket has a slot for attachment to the barricade and a round aperture for attachment to the flasher light unit. When attached to the barricade, the bracket and flasher may be rotated out of position to facilitate maintenance and rotated back into proper position for use. To prevent the accidental misaligning of the flasher during use, small protrusions on the barricade hold the bracket and flasher firmly in a proper vertical position.

13 Claims, 3 Drawing Sheets

FLASHER LIGHT MOUNTING ASSEMBLY FOR TRAFFIC BARRICADES

FIELD OF THE INVENTION

This invention relates in general to traffic barricades. It relates particularly to barricades having flasher light units mounted thereon.

Portable traffic barricades are now widely utilized to control traffic or protect vehicles from road hazards. Made from plastic or metal and wood combinations, these barricades typically comprise two generally planar panels fastened together at one end by hinges. The hinges allow the barricades to be opened for use or folded flat for storage or transport.

Such barricades are often fitted with a flasher light unit which is attached to a hinge bolt on the barricade. The flasher light unit generally comprises a lower housing containing a battery and an upper lens containing a bulb and reflector. The housing of the flasher light unit is attached to the hinge bolt with a mounting bracket.

An example of a prior art bracket and flasher light unit mounting assembly on a traffic barricade is seen in the Thurston U.S. Pat. No. 4,516,109. There it will be seen that the bracket is an elongated, rectangular member with a longitudinal slot in one end and a round aperture in the other end. The round aperture lies within a cup-shaped recess.

The bracket member receives a hinge bolt from the barricade through the slot. A washer and nut on the threaded end of the hinge bolt protruding through the slot may be tightened down to hold the bracket tightly against the sides of the corresponding barricade hinge.

The light unit is, in turn, fastened to the bracket with a fastening bolt which extends through the round aperture and into an internally threaded bore in the light unit housing. The head of the bolt is enclosed by the cupped recess of the bracket when the fastening bolt is tightened. The cupped shape recess sufficiently encloses the head of the bolt inserted through it to make it difficult for thieves or vandals to remove the bolt through conventional means. Furthermore, the head of the bolt is shaped in such a way that it is not engageable by a conventionally available socket wrench.

Prior art light unit mounting assemblies and brackets such as hereinbefore described have shortcomings, however. They allow the flasher light unit to rotate for easier maintenance access, but this often allows the flasher light assembly to be jarred out of its proper position upon the saddle. The mispositioning of the assembly causes the lamp to cast its beam in improper directions, which can be uneconomical to users and dangerous to vehicles. In order to prevent the flasher light assembly from being jarred out of position, the bolts must be tightened often. This is an inconvenience to the user. If the bolts on the bracket means are tightened sufficiently to prevent the flasher light assembly from jarring out of position, the bolts must be loosened for maintenance. This is time consuming. The inconvenience becomes especially severe where hundreds of barricades are used, as they often are.

BRIEF SUMMARY OF THE INVENTION

It is an object of the present invention to provide an improved flasher light mounting assembly for traffic barricades.

It is another object to provide a mounting assembly which prevents the flasher light from slipping into an improper position during use.

It is still another object to provide a mounting assembly which facilitates removing, replacing, and aligning the flasher light on the barricade.

The present embodiment provides an improved mounting assembly for flasher light units on road barricades. The assembly includes a flasher light unit, bracket, and road barricade combination. The road barricade has a pair of planar leg panels which have cross bars and hinge members. The leg panels are attached together at the hinge members by a hinge bolt. The cross-bars form a saddle area at the top of the barricade.

A plastic bracket is provided to mount the flasher light assembly to the barricade. The bracket is in the form of an elongated base with a longitudinally extending slot and a round aperture. The slot is located at one end of the bracket and receives the hinge bolt for attachment of the bracket to the barricade. The bolt is freely slidable in this slot. The round aperture is located at the opposite end of the bracket and receives a bolt for attachment to the flasher light assembly. The bracket base is surrounded by side walls which extend perpendicularly from the edges of the base.

The conventional flasher light assembly is mounted to the bracket by a fastening bolt inserted through the round aperture of the bracket. The bolt then screws into a threaded socket in the lower portion of the flasher light unit. When tightened, the head of the bolt lies in a cupped recess in the bracket, thereby deterring theft.

The bracket is mounted on the road barricade by a hinge bolt inserted through the hinge members joining the two planar leg panels and then the slot in the bracket. A nut is used to tighten the bracket to the hinge bolt. The nut need only be tightened until the bracket and the flasher light assembly are held snugly to the leg portions. The bracket should remain rotatable around the axis of the hinge bolt, and the hinge bolt should remain slidable within the bracket slot.

When tightened against the hinge members, the bracket is hindered in its rotation by two protrusions, one projecting toward the saddle from the hinge members of each leg panel. The protrusions are slightly rounded or dome-shaped, and project $\frac{1}{8}$ to $\frac{1}{4}$ inch from the surfaces of the hinge members.

In order to overcome the obstruction of the protrusions during the positioning of the light unit, the bracket must be rotated with some force past the protrusions. Because the protrusions are molded out of the same plastic that is used to mold the leg portions, the protrusions are resilient and deformable enough to allow the bracket to be rotated over them with sufficient force. The rounded or dome-shaped contour of the protrusions also aid in rotating the bracket.

Once the bracket is rotated into a vertical position with the slot positioned above the round aperture, the bracket lies nested between the two protrusions on the hinge members. The protrusions are positioned at the sides of the bracket in this position, and effectively clasp the bracket, or thus hindering preventing the sideways movement and rotation of the bracket. Although a single protrusion is present on each hinge member in the preferred embodiment, the invention disclosed herein is not limited to such a structure. The number and shape of the protrusions can vary so long as they hinder or prevent the sideways movement and rotation of the bracket.

When the flasher light unit is attached to the bracket and lowered onto the saddle of the barricade, the unit is held securely in an upright vertical position. The hinge bolt holding the bracket to the barricade does not need further tightening to hold the bracket and the flasher light unit in the proper position. The protrusions allow users to quickly "seat" the flasher assembly during use.

Once in the vertical position between the protrusions, the bracket and flasher require much more force to be knocked out of their proper position than when conventional brackets are used. In the improved combination, the flasher light unit is less likely to be misaligned by road workers or knocked out of position by common disturbances.

DESCRIPTION OF THE PREFERRED EMBODIMENT

Figure 1:
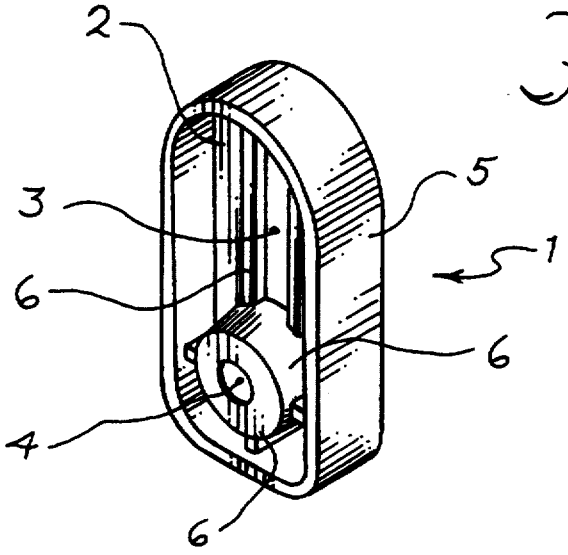
FIG. 1 is a perspective view of a bracket for mounting a flasher light unit to a traffic barricade.

Referring now to the drawings and especially to FIG. 1, a bracket generally indicated by numeral 1 is shown. The bracket 1 has a base 2 containing a longitudinally extending slot 3 at one end of base 2. An aperture 4 is defined in the opposite end of base 2. Surrounding the edges of base 2 are side walls 5, which project perpendicularly from the edges of base 2. The side walls 5 are connected to webs 6 which reinforce and surround the bracket 1, slot 3, and aperture 4.

Figure 2:
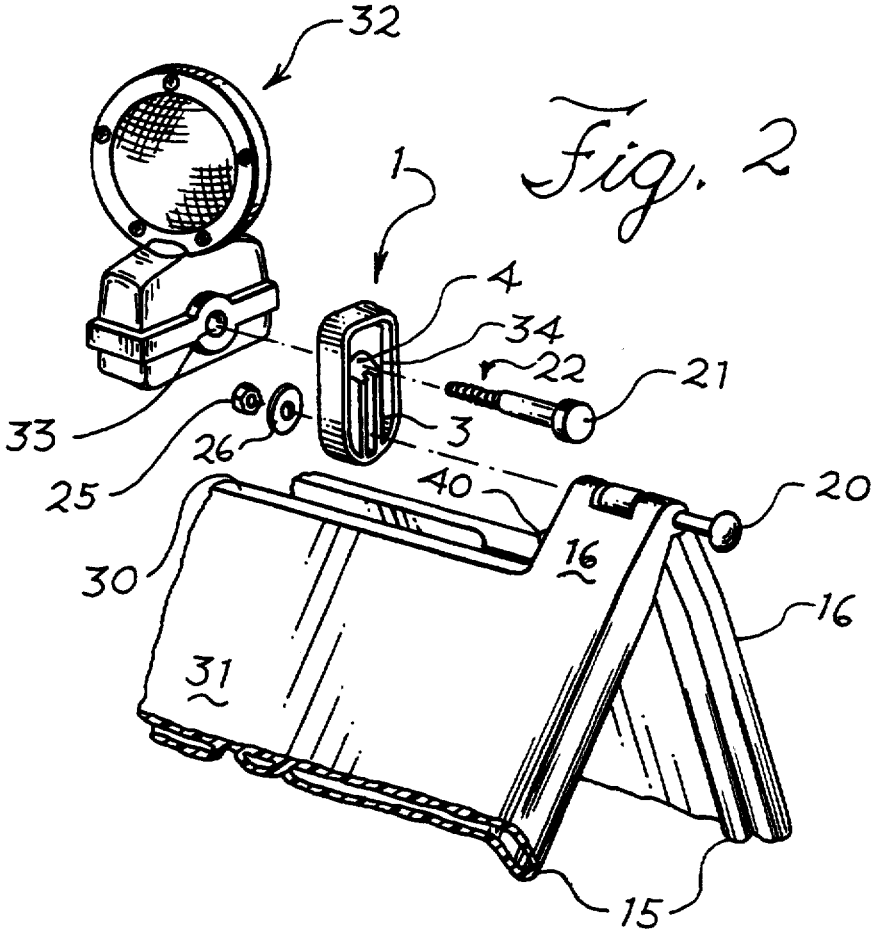
FIG. 2 is a exploded view showing the assembly of the flasher light unit, bracket, and traffic barricade.

The mounting of the bracket in relation to the flasher light unit and the traffic barricade are visible in FIG. 2. In this drawing, the planar leg panels 15 which form the traffic barricade are attached together at hinge members 16 by hinge bolt 20. Saddle 30 is formed by the cross-bars 31 on the leg panels 15.

The bracket 1 is fastened against the hinge members 16 by hinge bolt 20, which is in turn inserted into slot 3 of bracket 1. A nut 25 and washer 26 on the end of hinge bolt 20 is used to tighten the bracket 1 to hinge members 16. Flasher light unit 32 is mounted to bracket 1 using a fastening bolt 22. Bolt 22 is inserted through aperture 4 of the bracket and into threaded socket 33 in flasher light unit 32. Note that the head 21 of fastening bolt 22 is of a theft-proof design, and that the head 21 fits within cupped recess 34 of bracket 1.

Figure 3:
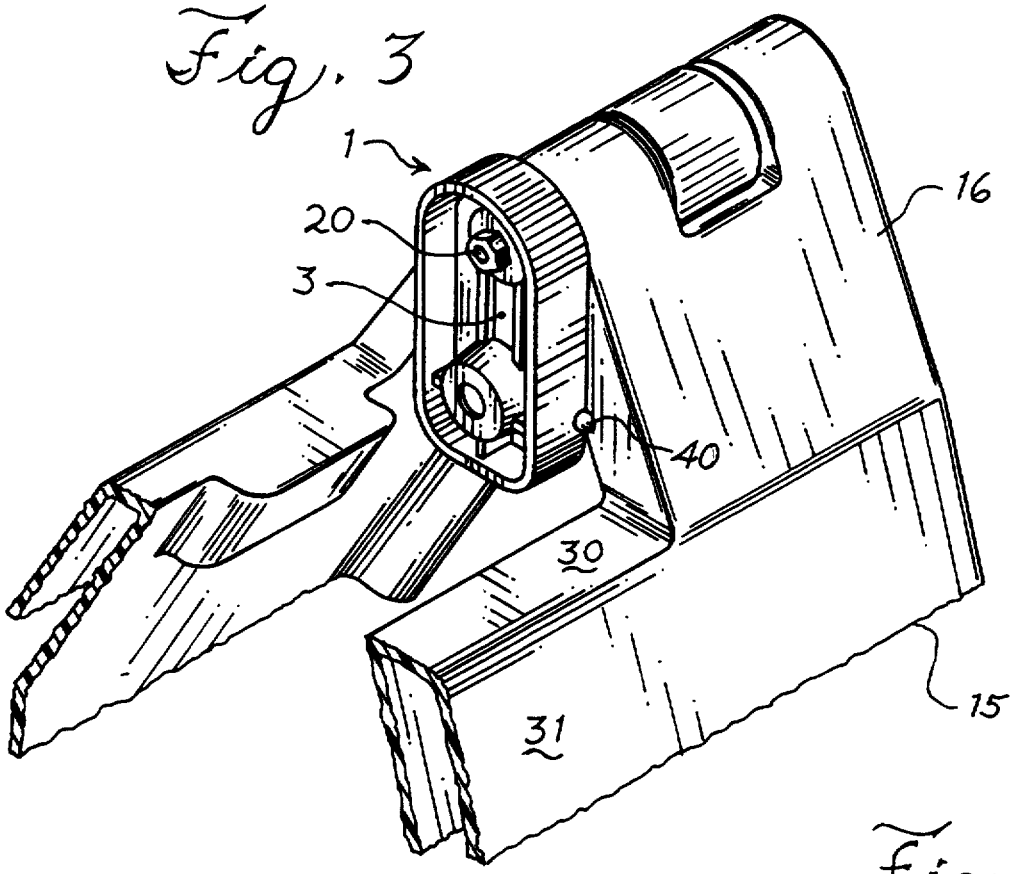
FIG. 3 is a perspective view showing the bracket mounted to the hinge members in proper position for use.

In FIG. 3, the bracket 1 is visible showing the end of hinge bolt 20 projecting through slot 3. The bracket 1 is rotatable around the axis of the hinge bolt 20. The hinge bolt 20 is also freely slidable within slot 3 of the bracket. Also visible is protrusion 40, which projects from the hinge member 16 of leg panel 15.

Figure 4:
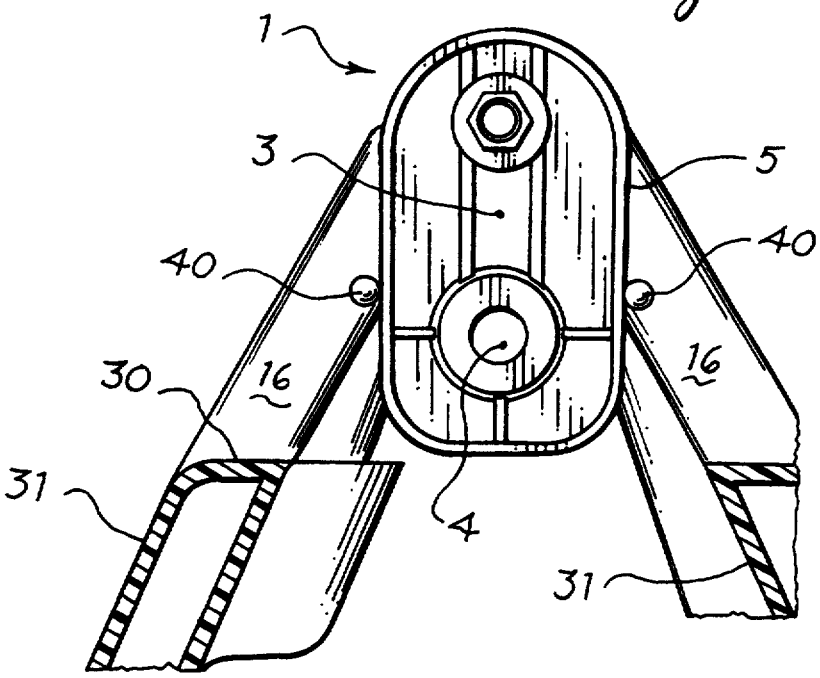
FIG. 4 is a side view showing the bracket in proper position for use.
Figure 5:
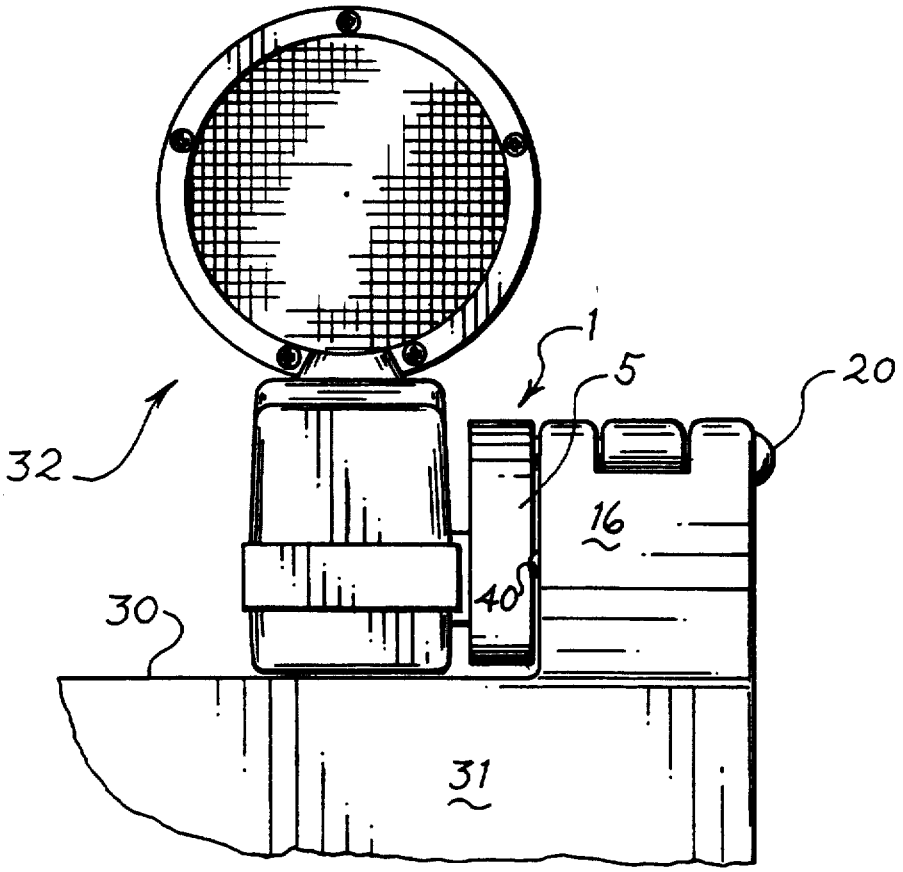
FIG. 5 is a side view showing the flasher light unit resting on the saddle of the barricade.

FIG. 4 shows bracket 1 in a vertical position with the slot 3 positioned above aperture 4. Side walls 5 on bracket 1 are engaged by the pair of protrusions 40 projecting from hinge members 16. As also shown in FIG. 5, bracket 1 and side walls 5 are adapted to fit snugly between protrusions 40. Cross-bars 31 form saddle 30. When the flasher light unit 32 is mounted to aperture 4 and the assembly is rotated so the aperture 4 is directly below slot 3, the bottom of the unit may rest on saddle 30. This is the proper position for the bracket and flasher light assembly during use.

With the flasher light unit 32 mounted in this fashion, the user can simply rotate the bracket and flasher unit out of proper position to facilitate maintenance of the unit. With the flasher light unit 32 rotated around the axis of hinge bolt 20 so the aperture 4 is above slot 3, the user may easily access the head 21 of fastening bolt 22. If needed, the light unit may be easily detached from the bracket 1 and replaced. The bracket 1 can be left mounted on the hinge bolt 20 when the light unit is detached. When the user reattaches the flasher light unit, the assembly is rotated back into proper position on the saddle 30 of the barricade. The protrusions 40 on the hinge members firmly snap the bracket 1 into proper position and retain it in this position during use.

When the user rotates the bracket 1 either into or out of proper position, he or she must use a small, yet significant amount of force to turn the bracket past the protrusions 40 on the hinge members 16. This necessary force prevents common road or construction disturbances from accidentally knocking the flasher light unit and bracket out of alignment.

I claim:

1. In a traffic barricade assembly wherein the barricade includes a pair of generally planar panels having upper cross-bars and opposed hinge members extending upwardly from the cross-bars, the opposed hinge members being hinged together with a hinge bolt and the cross-bars forming a saddle for a flasher light unit, the flasher light unit being fastened to the hinge bolt by a bracket and a fastening bolt, an improvement wherein:

said bracket includes a base and longitudinally extending side walls upstanding from said base;

a longitudinally extending slot through one end of said base and an aperture through the other end of said base;

said hinge bolt extending through said slot;

means on the end of said hinge bolt for releasably holding said bracket base against said hinge members; and protrusions formed on each of said hinge members for holding said bracket in vertical position.

2. The improvement as recited in claim 1 wherein said protrusions further comprise a structure for clasping said bracket.

3. The improvement as recited in claim 1 wherein said protrusions hinder the free rotation of said bracket around the axis of said hinge bolt.

4. The improvement as recited in claim 1 wherein said protrusions have rounded edge surfaces.

5. The improvement as recited in claim 1 wherein said bracket is made from a plastic material.

6. The improvement as recited in claim 1 wherein said aperture includes a cupped recess.

7. The improvement as recited in claim 6 wherein the head of said fastening bolt is recessed within said cupped recess.

8. The improvement as recited in claim 1 wherein the head of said fastening bolt is of an anti-theft configuration and not readily engageable by conventional tools.

9. The improvement as recited in claim 1 wherein said means on end of said hinge bolt for releasably holding said bracket against said hinge members includes a nut on the end of said hinge bolt.

10. The improvement as recited in claim 1 wherein said means on the end of said hinge bolt for holding said bracket against said hinge members includes a nut welded to the end of said hinge bolt.

11. The improvement as recited in claim 1 wherein said hinge bolt is freely slidable within said slot.

12. In a traffic barricade assembly wherein the barricade includes a pair of generally planar panels having upper cross-bars and opposed hinge members extending upwardly from the cross-bars, the opposed hinge members being hinged together with a hinge bolt and the cross-bars forming a saddle for a flasher light unit, the flasher light unit being fastened to the hinge bolt by a bracket and a fastening bolt, an improvement wherein:

said bracket includes a base and longitudinally extending side walls upstanding from said base;

a longitudinally extending slot through one end of said base;

said hinge bolt extending through said slot;

means on the end of said hinge bolt for holding said bracket against said hinge members;

said fastening bolt extending through said aperture;

means on said flasher light unit for receiving said fastening bolt and holding said flasher light unit against said bracket; and a single protrusion formed on each of said hinge members, said protrusions cooperating to claps said bracket in a vertical position, said protrusions being of a size such that said bracket may be rotated either clockwise or counter-clockwise over said protrusions and around said hinge bolt.

13. In a traffic barricade assembly wherein the barricade includes a pair of generally planar panels having upper cross-bars and opposed hinge members extending upwardly from the cross-bars, the opposed hinge members being hinged together with a hinge bolt and the cross-bars forming a saddle for a flasher light unit, the flasher light unit being fastened to the hinge bolt by a bracket and a fastening bolt, an improvement wherein:

said bracket includes a base;

a longitudinally extending slot through one end of said base and an aperture through the other end of said base;

said hinge bolt extending through said slot;

means on the end of said hinge bolt for holding said bracket against said hinge members; and a plurality of protrusions on each of said hinge members adapted to clasp said bracket and hinder rotation of said bracket around said hinge bolt.

* * * * *

UNITED STATES PATENT AND TRADEMARK OFFICE

CERTIFICATE OF CORRECTION

PATENT NO. : 5,342,140

DATED : August 30, 1994

INVENTOR(S) : Geoffrey M. Glass

It is certified that error appears in the above-indentified patent and that said Letters Patent is hereby corrected as shown below:

IN THE CLAIMS

Col. 5,

In Claim 12, after line 20, insert the following new paragraph --a cupped aperture through the other end of said base;--

Col.6,

In claim 12, line 5, delete "claps" and substitute --clasp--.

Signed and Sealed this

Sixteenth Day of May, 1995

*Attest:*

Bruce Lehman

BRUCE LEHMAN

*Attesting Officer*

*Commissioner of Patents and Trademarks*